US006535054B1

(12) United States Patent
Ceekala et al.

(10) Patent No.: US 6,535,054 B1
(45) Date of Patent: Mar. 18, 2003

(54) BAND-GAP REFERENCE CIRCUIT WITH OFFSET CANCELLATION

(75) Inventors: Vijaya G. Ceekala, Santa Clara, CA (US); Laurence Douglas Lewicki, Santa Clara, CA (US); James B. Wieser, Pleasanton, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/032,107

(22) Filed: Dec. 20, 2001

(51) Int. Cl.[7] ..... G05F 1/10
(52) U.S. Cl. ..... 327/539
(58) Field of Search ..... 327/530, 538, 327/539, 540, 541

(56) References Cited

U.S. PATENT DOCUMENTS 4,375,595 A * 3/1983 Ulmer et al. ..... 327/378
5,087,834 A * 2/1992 Tsay ..... 326/33
5,352,972 A * 10/1994 Pernici et al. ..... 323/313
6,275,098 B1 * 8/2001 Uehara et al. ..... 327/539

* cited by examiner

*Primary Examiner*—Jeffrey Zweizig
(74) *Attorney, Agent, or Firm*—Davis Munck, P.C.

(57) ABSTRACT

A band-gap reference circuit with offset cancellation is provided that includes a differential amplifier circuit. The differential amplifier circuit includes a first input node and a second input node. The first input node is operable to receive a first input signal. The second input node is operable to receive a second input signal. The band-gap reference circuit is operable to alternate between a first state and a second state based on a specified duty cycle. The first input node is an inverting node and the second input node is a non-inverting node in the first state, and the first input node is a non-inverting node and the second input node is an inverting node in the second state. The differential amplifier circuit is operable to generate an output signal based on a difference between the first and second input signals.

20 Claims, 3 Drawing Sheets

BAND-GAP REFERENCE CIRCUIT WITH OFFSET CANCELLATION

TECHNICAL FIELD OF THE INVENTION

The present invention relates generally to reference voltage circuits and, more particularly, to a band-gap reference circuit with operational amplifier offset cancellation.

BACKGROUND OF THE INVENTION

The rapid proliferation of local area network (LANs) in the corporate environment and the increased demand for time-sensitive delivery of messages and data between users has spurred development of high-speed (gigabit) Ethernet LANs. The 100BASE-TX Ethernet LANs using category-5 (CAT-5) copper wire and the 1000BASE-T Ethernet LANs capable of one gigabit per second (1 Gbps) data rates over CAT-5 data grade wire use new techniques for the transfer of high-speed data symbols.

Conventional 1000BASE-T Ethernet LAN drivers, in addition to nearly all other signal processing/communication chips and systems, use band-gap reference circuits. These band-gap reference circuits are able to generate relatively constant reference voltages that have a well-defined magnitude, as well as minimal process variation, temperature variation, and voltage variation.

However, conventional CMOS-based band-gap reference circuits are highly prone to variations as a result of random mismatches of the MOS transistors. These mismatches are often manifested as current mismatches and, in the case of operational amplifiers, as offset voltages.

SUMMARY OF THE INVENTION

In accordance with the present invention, a band-gap reference circuit with offset cancellation is provided that substantially eliminates or reduces disadvantages and problems associated with conventional systems. In particular, input offset voltages and component mismatches due to process variation are averaged out, resulting in the band-gap reference circuit generating a more stable reference voltage.

According to one embodiment of the present invention, a band-gap reference circuit with offset cancellation is provided that includes a differential amplifier circuit. The differential amplifier circuit includes a first input node and a second input node. The first input node is operable to receive a first input signal. The second input node is operable to receive a second input signal. The band-gap reference circuit is operable to alternate between a first state and a second state based on a specified duty cycle. The first input node is an inverting node and the second input node is a non-inverting node in the first state, and the first input node is a non-inverting node and the second input node is an inverting node in the second state. The differential amplifier circuit is operable to generate an output signal based on a difference between the first and second input signals.

According to another embodiment of the present invention, a band-gap reference circuit with offset cancellation is provided that includes a first PMOS transistor, a second PMOS transistor, a third PMOS transistor, a fourth PMOS transistor, a first first-state switch, and a first second-state switch. The first PMOS transistor has a source coupled to a power supply. The second PMOS transistor has a source coupled to a drain of the first PMOS transistor and a gate coupled to a first input node. The third PMOS transistor has a source coupled to the power supply and a gate coupled to a gate of the first PMOS transistor. The fourth PMOS transistor has a source coupled to a drain of the third PMOS transistor, a drain coupled to a drain of the second PMOS transistor and to ground, and a gate coupled to a second input node. The first first-state switch is operable to couple the drain of the first PMOS transistor to the gate of the first PMOS transistor when the band-gap reference circuit is in a first state. The first second-state switch is operable to couple the drain of the third PMOS transistor to the gate of the third PMOS transistor when the band-gap reference circuit is in a second state.

Technical advantages of one or more embodiments of the present invention include providing an improved band-gap reference circuit. In a particular embodiment, the band-gap reference circuit alternates between a first state and a second state based on a specified duty cycle. When the band-gap reference circuit is in the first state, a first input node for a differential amplifier circuit comprises an inverting node and a second input node for the differential amplifier circuit comprises a non-inverting node. When the band-gap reference circuit is in the second state, the first input node comprises a non-inverting node and the second input node comprises an inverting node. As a result, offset cancellation is provided for the band-gap reference circuit. Accordingly, the input offsets of the differential amplifier circuit and component mismatches due to process variation are averaged out, resulting in a more stable reference voltage.

Other technical advantages will be readily apparent to one skilled in the art from the following figures, description, and claims.

Before undertaking the DETAILED DESCRIPTION OF THE INVENTION, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention and its advantages, reference is now made to the following description taken in conjunction with the accompanying drawings, wherein like reference numerals represent like parts, in which.

DETAILED DESCRIPTION OF THE INVENTION

Figure 1:
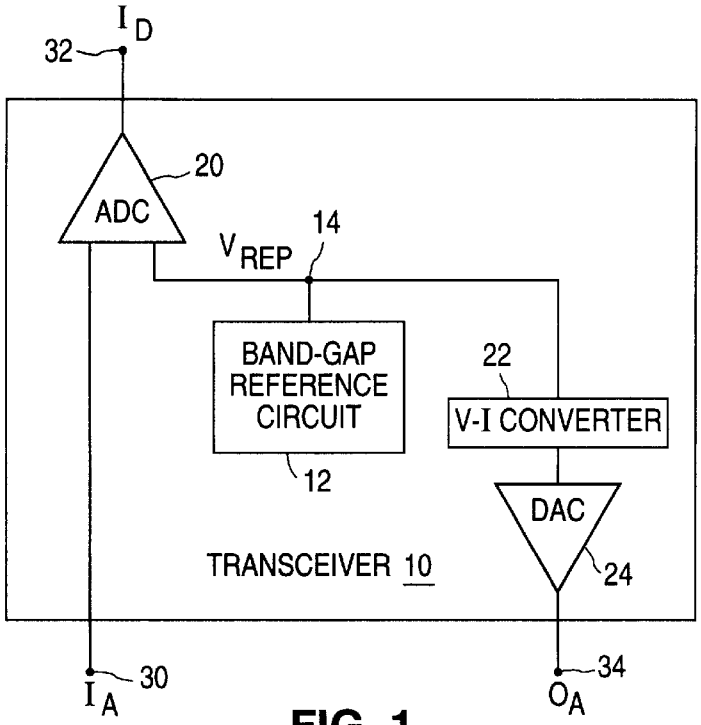
FIG. 1 is a block diagram illustrating a transceiver including a band-gap reference circuit with offset cancellation in accordance with one embodiment of the present invention.
Figure 2:
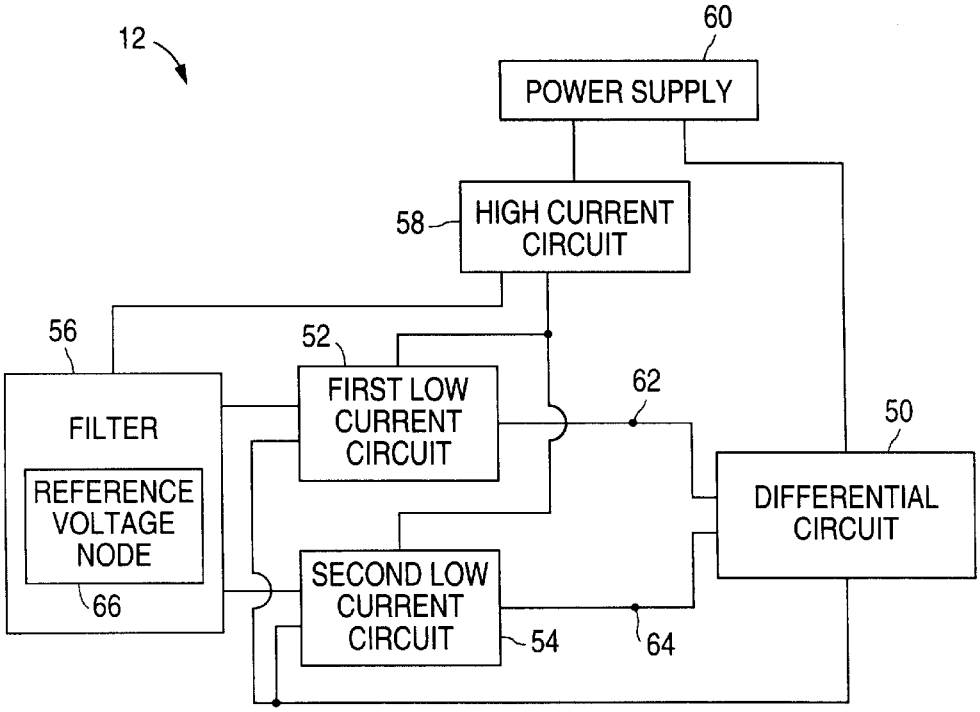
FIG. 2 is a block diagram illustrating the band-gap reference circuit of FIG. 1 in accordance with one embodiment of the present invention.

FIGS. 1 through 3, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged band-gap reference circuit.

FIG. 1 is a block diagram illustrating a transceiver 10 in accordance with one embodiment of the present invention. According to one embodiment, the transceiver 10 comprises a gigabit Ethernet transceiver. However, it will be understood that the transceiver 10 may comprise any suitable transceiver operable to receive and transmit data.

The transceiver 10 comprises a band-gap reference circuit 12 that is operable to generate a reference voltage 14 for the transceiver 10. As described in more detail below, the band-gap reference circuit 12 is operable to alternate between different states in order to provide offset cancellation, which minimizes offset voltages and current mismatches that may result from process, voltage, and temperature variations.

The transceiver 10 also comprises an analog-to-digital converter (ADC) 20, a voltage-to-current (V-I) converter 22, and a digital-to-analog converter (DAC) 24, in addition to any other suitable circuitry. The ADC 20, which is coupled to the band-gap reference circuit 12, is operable to receive an analog input signal ($I_A$) 30 and the reference voltage 14 and to generate a digital input signal ($I_D$) 32 based on the analog input signal 30 and the reference voltage 14.

The V-I converter 22, which is also coupled to the band-gap reference circuit 12, is operable to receive the reference voltage 14 and to convert the reference voltage 14 into a specified current based on the reference voltage 14. The DAC 24 is coupled to the V-I converter 22 and is operable to transmit an analog output signal ($O_A$) 34 based on the specified current from the V-I converter 22.

In operation, the band-gap reference circuit 12 of the transceiver 10 alternates between a first state and a second state based on a specified duty cycle. According to one embodiment, the specified duty cycle comprises about 50%. Thus, for this embodiment, the band-gap reference circuit 12 may be in the first state for approximately the first half of the time period and in the second state for approximately the second half of the time period. However, it will be understood that the states may be otherwise allocated within the time period without departing from the scope of the present invention.

The band-gap reference circuit 12 generates the reference voltage 14 and provides the reference voltage 14 to both the ADC 20 and the V-I converter 22. The ADC 20 may also receive an analog input signal 30 and may convert that signal 30 into a digital input signal 32 based on the reference voltage 14. The V-I converter 22 converts the reference voltage 14 into a specified current and provides the specified current to the DAC 24. The DAC 24 may generate an analog output signal 34 based on the specified current and transmit the analog output signal 34 from the transceiver 10 to any other suitable component.

FIG. 2 is a block diagram illustrating the band-gap reference circuit 12 in accordance with one embodiment of the present invention. It will be understood that, in addition to being included in a transceiver 10, the band-gap reference circuit 12 may be included in any other suitable circuit with a use for a relatively constant reference voltage 14 without departing from the scope of the present invention.

The band-gap reference circuit 12 comprises a differential amplifier circuit 50, a first low current circuit 52, a second low current circuit 54, a filter 56, a high current circuit 58, and a power supply 60. The differential amplifier circuit 50 is coupled to the low current circuits 52 and 54 and to the power supply 60. The differential amplifier circuit 50 is operable to receive a first input signal from the first low current circuit 52 at a first input node 62 and to receive a second input signal from the second low current circuit 54 at a second input node 64. The differential amplifier circuit 50 is also operable to generate an output signal based on the input signal difference.

The low current circuits 52 and 54 are coupled to the differential amplifier circuit 50, to the filter 56 and to the high current circuit 58. The low current circuits 52 and 54 are operable to receive the output signal from the differential amplifier circuit 50 and a signal from the high current circuit 58 and to generate the first and second input signals based on the output signal and the signal from the high current circuit 58.

The filter 56 is connected to the low current circuits 52 and 54 and to the high current circuit 58. The filter 56 is operable to filter out switching spikes and spikes related to offset voltages from the reference voltage. The filter 56 also comprises a reference voltage node 66 that is operable to generate a reference voltage.

The high current circuit 58 is coupled to the low current circuits 52 and 54, to the filter 56 and to the power supply 60. The high current circuit 58 is operable to provide a bias voltage for the low current circuits 52 and 54 and to provide a filter current to the filter 56.

The power supply 60 is coupled to the differential amplifier circuit 50 and to the high current circuit 58. The power supply 60 is operable to provide a specified voltage and/or current to the differential amplifier circuit 50 and the high current circuit 58. According to one embodiment, the power supply 60 is operable to provide about 3.3 volts.

In operation, the power supply 60 provides power to the differential amplifier circuit 50 and to the high current circuit 58, which provides a bias voltage to the low current circuits 52 and 54 and a filter current to the filter 56. The filter 56 filters out switching spikes at a reference voltage node 66 that is operable to generate a reference voltage.

The low current circuits 52 and 54 receive an output signal from the differential amplifier circuit 50 and a signal from the high current circuit 58. The first and second low current circuits 52 and 54 then generate a first input signal and a second input signal, respectively, based on the output signal and the signal from the high current circuit 58.

The differential amplifier circuit 50 receives the first input signal from the first low current circuit 52 at the first input node 62 and the second input signal from the second low current circuit 54 at the second input node 64. The differential amplifier circuit 50 then generates the output signal based on the input signal difference.

The band-gap reference circuit 12 alternates between a first state and a second state based on a specified duty cycle. According to one embodiment, the specified duty cycle comprises about 50%. For this embodiment, when the band-gap reference circuit 12 is in the first state, the first input node 62 comprises an inverting node and the second input node 64 comprises a non-inverting node. When the band-gap reference circuit 12 is in the second state, the first input node 62 comprises a non-inverting node and the second input node 64 comprises an inverting node.

Thus, for one embodiment, the first input node 62 comprises an inverting node for about one-half of the time period and then alternates to a non-inverting node for the other half of the time period. Similarly, the second input node 64 comprises a non-inverting node for about one-half of the time period and then alternates to an inverting node for the other half of the time period. In this way, the input offsets of the differential amplifier circuit 50 and component mismatches due to process variation are averaged out, resulting in a more stable reference voltage.

Figure 3A:
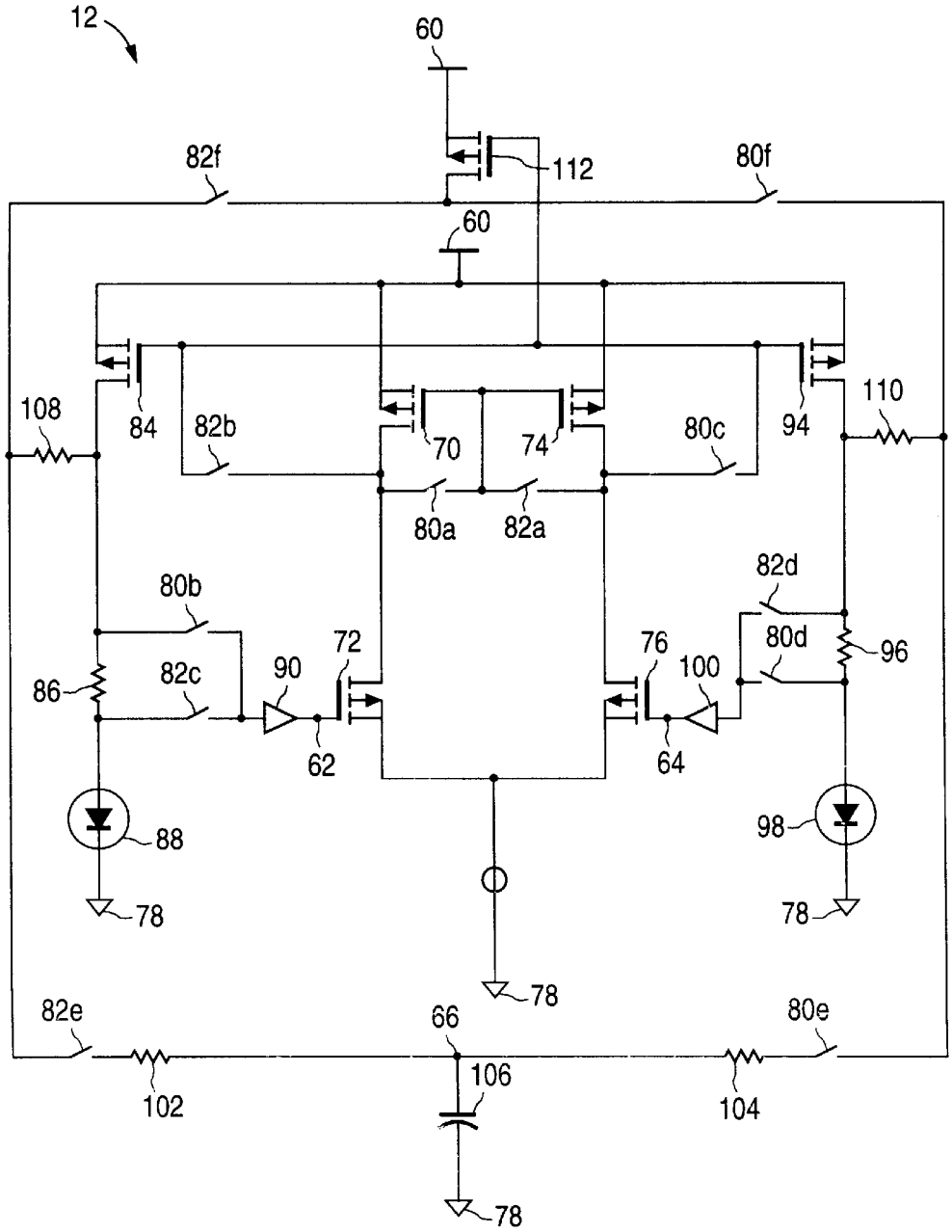
FIGS. 3A–C are circuit diagrams illustrating the band-gap reference circuit of FIG. 2 in accordance with one embodiment of the present invention.
Figure 3B:
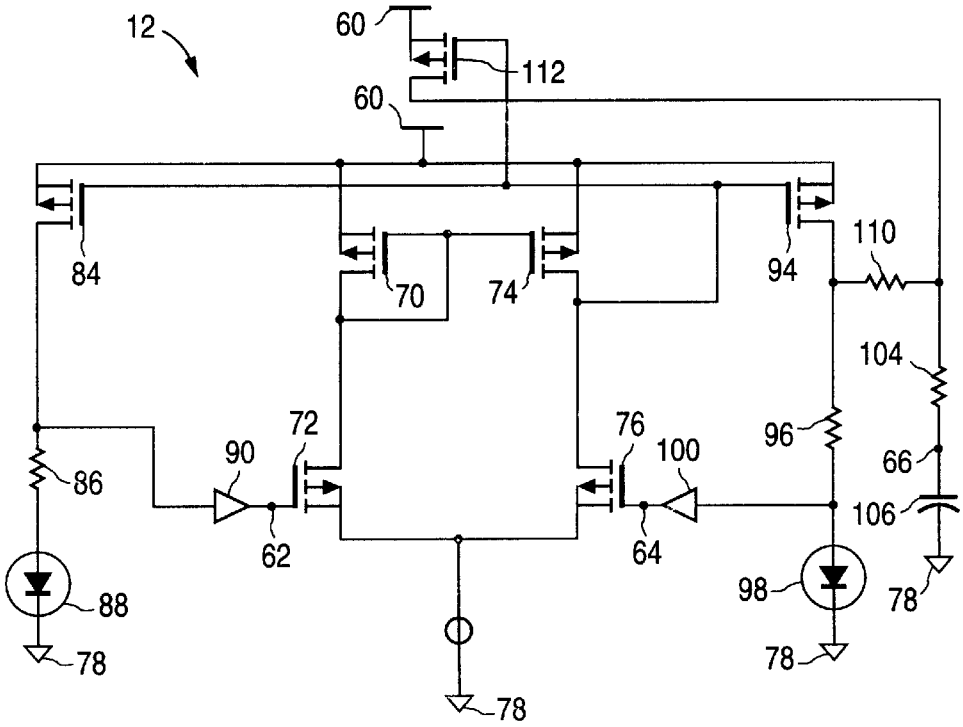
Figure 3C:
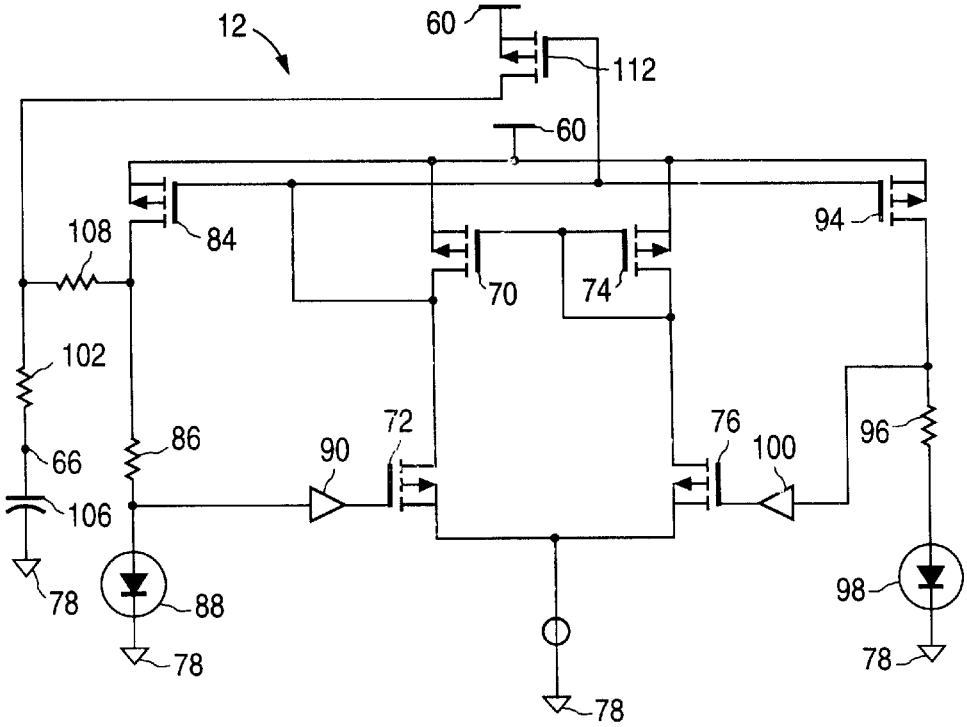

FIGS. 3A–C are circuit diagrams illustrating the band-gap reference circuit 12 in accordance with one embodiment of the present invention. FIG. 3A illustrates the band-gap reference circuit 12 with switches that are operable to place the band-gap reference circuit 12 into either the first state or the second state. FIG. 3B illustrates the band-gap reference circuit 12 in the first state, omitting the elements that do not function during the first state as a result of action of the switches in the first state. FIG. 3C illustrates the band-gap reference circuit 12 in the second state, omitting the elements that do not function during the second state as a result of action of the switches in the second state.

According to the illustrated embodiment, the power supply 60 comprises a voltage source. The power supply 60 may be operable to provide about 3.3 volts or any other suitable amount of voltage to the band-gap reference circuit 12.

The differential amplifier circuit 50 in the illustrated embodiment comprises a CMOS Miller operational transconductance amplifier. However, it will be understood that the differential amplifier circuit 50 may comprise a series of high-gain folded cascode stages or any other suitable differential amplifier circuit operable to receive two inputs and generate an output based on the input difference.

The differential amplifier circuit 50 comprises a first PMOS transistor 70, a second PMOS transistor 72, a third PMOS transistor 74, and a fourth PMOS transistor 76. The sources of the first PMOS transistor 70 and the third PMOS transistor 74 are coupled to the power supply 60 and the gates of the first PMOS transistor 70 and the third PMOS transistor 74 are coupled to each other.

The drain of the first PMOS transistor 70 is coupled to the source of the second PMOS transistor 72, and the drain of the third PMOS transistor 74 is coupled to the source of the fourth PMOS transistor 76. The drains of the second PMOS transistor 72 and the fourth PMOS transistor 76 are coupled to each other and to ground 78. The gate of the second PMOS transistor 72 is coupled to the first input node 62, and the gate of the fourth PMOS transistor 76 is coupled to the second input node 64.

The differential amplifier circuit 50 also comprises a first-state switch 80*a* and a second-state switch 82*a*. First-state switches 80 are operable to close the circuit when the band-gap reference circuit 12 is in the first state and to open the circuit when the band-gap reference circuit 12 is in the second state. Similarly, second-state switches 82 are operable to close the circuit when the band-gap reference circuit 12 is in the second state and to open the circuit when the band-gap reference circuit 12 is in the first state.

According to one embodiment, the switches 80 and 82 function in accordance with two complementary clock phases. Thus, for this embodiment, the switches 80 are open while the switches 82 are closed, and the switches 80 are closed while the switches 82 are open.

The first low current circuit 52 comprises a PMOS transistor 84, a resistor 86, and a diode 88. The source of the PMOS transistor 84 is coupled to the power supply 60. The drain of the PMOS transistor 84 is coupled to the resistor 86. According to one embodiment, the diode 88 comprises a vertical pnp transistor with its base and collector coupled to ground 78 and its emitter coupled to the resistor 86.

The first low current circuit 52 also comprises a first-state switch 80*b* and two second-state switches 82*b* and 82*c*. The first low current circuit 52 is coupled to a level shifter 90 that is operable to shift the voltage level of the first input signal provided by the first low current circuit 52 to the first input node 62. Thus, the level shifter 90 may be operable to adjust a voltage swing for the first low current circuit 52 from a higher value to a lower value. The level shifter 90 is coupled to the gate of the second PMOS transistor 72 of the differential amplifier circuit 50 and is operable to bias the second PMOS transistor 72.

The second low current circuit 54 comprises a PMOS transistor 94, a resistor 96, and a diode 98. The source of the PMOS transistor 94 is coupled to the power supply 60. The drain of the PMOS transistor 94 is coupled to the resistor 96. According to one embodiment, the diode 98 comprises a vertical pnp transistor with its base and collector coupled to ground 78 and its emitter coupled to the resistor 96.

The second low current circuit 54 also comprises two first-state switches 80*c* and 80*d* and a second-state switch 82*d*. The second low current circuit 54 is coupled to a level shifter 100 that is operable to shift the voltage level of the second input signal provided by the second low current circuit 54 to the second input node 64. Thus, the level shifter 100 may be operable to adjust a voltage swing for the second low current circuit 54 from a higher value to a lower value. The level shifter 100 is coupled to the gate of the fourth PMOS transistor 76 of the differential amplifier circuit 50 and is operable to bias the fourth PMOS transistor 76.

The filter 56 comprises a first resistor 102, a second resistor 104, and a capacitor 106, in addition to the reference voltage node 66. The filter 56 also comprises a first-state switch 80*e* and a second-state switch 82*e*. The filter 56 is coupled to the first low current circuit 52 through a resistor 108. Resistor 108 is coupled to resistor 102 and to the drain of the PMOS transistor 84 of the first low current circuit 52. Similarly, the filter 56 is coupled to the second low current circuit 54 through a resistor 110. Resistor 110 is coupled to resistor 104 and to the drain of the PMOS transistor 94 of the second low current circuit 54.

The high current circuit 58 comprises a PMOS transistor 112. The source of the PMOS transistor 112 is coupled to the power supply 60, the gate of the PMOS transistor 112 is coupled to the gates of PMOS transistors 84 and 94 of the low current circuits 52 and 54, and the drain of the PMOS transistor 112 is coupled to switches 80*e* and 82*e* of the filter 56 and to resistors 108 and 110.

In accordance with one embodiment, the current through PMOS transistor 112 comprises about (N−1)I, the current through PMOS transistors 84 and 94 comprises about I, and the current through resistors 102 and 104 comprises about NI, with N being the current ratio. For example, for a current ratio of eight, the current through PMOS transistor 112 is about 7I, the current through PMOS transistors 84 and 94 is about I, and the current through resistors 102 and 104 is about 8I.

According to one embodiment, resistors 86 and 96 provide approximately 10 kΩ of resistance, resistors 102 and 104 provide approximately 40 kΩ of resistance, resistors 108 and 110 provide approximately 10 kΩ of resistance, and capacitor 106 provides approximately 40 pF of capacitance. However, it will be understood that these components may provide any suitable amount of resistance or capacitance without departing from the scope of the present invention.

In operation, when the band-gap reference circuit 12 is in the first state, the first-state switches 80 are closed and the second-state switches 82 are open. Thus, for the specified percentage of the time period corresponding to the first state, the band-gap reference circuit 12 may be illustrated as shown in FIG. 3B.

The gate of PMOS transistor 70 is shorted to the drain of PMOS transistor 70, and the drain of PMOS transistor 74 is coupled to the gate of PMOS transistor 94. A path is provided from the drain of PMOS transistor 112 to the reference voltage node 66 through resistor 104. Level shifter 90 is coupled between PMOS transistor 84 and resistor 86, while level shifter 100 is coupled between resistor 96 and diode 98.

Thus, while the band-gap reference circuit 12 is in the first state, the first input node 62 comprises an inverting node for the differential amplifier circuit 50, and the second input node 64 comprises a non-inverting node for the differential amplifier circuit 50.

Similarly, when the band-gap reference circuit 12 is in the second state, the second-state switches 82 are closed and the first-state switches 80 are open. Thus, for the specified percentage of the time period corresponding to the second state, the band-gap reference circuit 12 may be illustrated as shown in FIG. 3C.

The gate of PMOS transistor 74 is shorted to the drain of PMOS transistor 74, and the drain of PMOS transistor 70 is coupled to the gate of PMOS transistor 84. A path is provided from the drain of PMOS transistor 112 to the reference voltage node 66 through resistor 102. Level shifter 90 is coupled between resistor 86 and diode 88, while level shifter 100 is coupled between PMOS transistor 94 and resistor 96.

Thus, while the band-gap reference circuit 12 is in the second state, the first input node 62 comprises a non-inverting node for the differential amplifier circuit 50, and the second input node 64 comprises an inverting node for the differential amplifier circuit 50.

Referring to FIG. 3B, the band-gap reference circuit 12 is in the first state. Assuming that resistors 86, 96 and 110 each comprise an amount, R, of resistance, the following equation holds:

$$I=(V_{be2}-V_{be1})/R=(kT/q)*(\ln(N))*(1/R), \quad (1)$$

where $V_{be1}$ is the voltage drop across diode 88, $V_{be2}$ is the voltage drop across diode 98, and the current through PMOS transistor 112 is N−1 times the current through PMOS transistors 84 and 94. In this situation, the reference voltage at the reference voltage node 66 is given by:

$$V_{ref}=(kT/q)*(\ln(N))*(2N-1)+V_{be2}. \quad (2)$$

Similarly, when the band-gap reference circuit 12 is in the second state, as shown in FIG. 3C, the reference voltage at the reference voltage node 66 is given by:

$$V_{ref}=(kT/q)*(\ln(N))*(2N-1)+V_{be1}. \quad (3)$$

Thus, for a duty cycle of about 50% such that the band-gap reference circuit 12 alternates between the first and second state after half of each clock cycle, the reference voltage at the reference voltage node 66 is given by:

$$V_{ref}=((kT/q)*(\ln(N))*(2N-1)+V_{be1}+V_{be2})*(1/2). \quad (4)$$

Including offset voltages for the differential amplifier circuit 50, the reference voltage during the first state is given by:

$$V_{ref1}=V_{ref}+V_{off1}, \quad (5)$$

where $V_{ref}$ is given by equation 4, above, and $V_{off1}$ is the input referred offset during the first state.

Similarly, the reference voltage during the second state is given by:

$$V_{ref2}=V_{ref}-V_{off2}, \quad (6)$$

where $V_{ref}$ is given by equation 4, above, and $V_{off2}$ is the input referred offset during the second state.

Thus, assuming a 50% duty cycle, the reference voltage at the reference voltage node 66 has a DC mean value of approximately $V_{ref}$, as defined by equation 4, above, and switches over this value by $V_{off1}$ about 50% of the time and below this value by $V_{off2}$ about 50% of the time. In this way, variation in the reference voltage due to the input referred offsets for the differential amplifier circuit 50 is drastically reduced.

Although the present invention has been described with several embodiments, various changes and modifications may be suggested to one skilled in the art. It is intended that the present invention encompass such changes and modifications as fall within the scope of the appended claims.

What is claimed is:

1. A band-gap reference circuit with offset cancellation, comprising a differential amplifier circuit, the differential amplifier circuit comprising:

a first input node operable to receive a first input signal;

a second input node operable to receive a second input signal;

the band-gap reference circuit operable to alternate between a first state and a second state based on a specified duty cycle, the first input node comprising an inverting node and the second input node comprising a non-inverting node in the first state, and the first input node comprising a non-inverting node and the second input node comprising an inverting node in the second state; and the differential amplifier circuit operable to generate an output signal based on a difference between the first and second input signals.

2. The band-gap reference circuit of claim 1, the specified duty cycle comprising about 50%.

3. The band-gap reference circuit of claim 1, further comprising:

a first low current circuit coupled to the differential amplifier circuit, the first low current circuit operable to receive the output signal and to generate the first input signal based on the output signal; and a second low current circuit coupled to the differential amplifier circuit, the second low current circuit operable to receive the output signal and to generate the second input signal based on the output signal.

4. The band-gap reference circuit of claim 3, further comprising a filter coupled to the first and second low current circuits, the filter comprising a reference voltage node operable to provide a reference voltage.

5. The band-gap reference circuit of claim 4, the filter operable to filter out switching spikes at the reference voltage node.

6. The band-gap reference circuit of claim 5, further comprising a high current circuit coupled to the first and second low current circuits, the high current circuit operable to provide a bias voltage for the first and second low current circuits.

7. The band-gap reference circuit of claim 6, the high current circuit coupled to the filter and operable to provide a filter current to the filter.

8. A band-gap reference circuit with operational amplifier offset cancellation, comprising:

a first PMOS transistor having a source coupled to a power supply;

a second PMOS transistor having a source coupled to a drain of the first PMOS transistor and a gate coupled to a first input node;

a third PMOS transistor having a source coupled to the power supply and a gate coupled to a gate of the first PMOS transistor;

a fourth PMOS transistor having a source coupled to a drain of the third PMOS transistor, a drain coupled to a drain of the second PMOS transistor and to ground, and a gate coupled to a second input node;

a first first-state switch operable to couple the drain of the first PMOS transistor to the gate of the first PMOS transistor when the band-gap reference circuit is in a first state; and a first second-state switch operable to couple the drain of the third PMOS transistor to the gate of the third PMOS transistor when the band-gap reference circuit is in a second state.

9. The band-gap reference circuit of claim 8, further comprising:

a fifth PMOS transistor having a source coupled to the power supply;

a first resistor coupled to the fifth PMOS transistor;

a first diode coupled to the first resistor and to ground;

a second first-state switch operable to couple the drain of the fifth PMOS transistor to a first level shifter when the band-gap reference circuit is in the first state;

a second second-state switch operable to couple the diode to the first level shifter when the band-gap reference circuit is in the second state;

a third second-state switch operable to couple the gate of the fifth PMOS transistor to the drain of the first PMOS transistor when the band-gap reference circuit is in the second state;

a sixth PMOS transistor having a source coupled to the power supply and a gate coupled to a gate of the fifth PMOS transistor;

a second resistor coupled to the sixth PMOS transistor;

a second diode coupled to the second resistor and to ground;

a fourth second-state switch operable to couple the drain of the sixth PMOS transistor to a second level shifter when the band-gap reference circuit is in the second state;

a third first-state switch operable to couple the diode to the second level shifter when the band-gap reference circuit is in the first state; and a fourth first-state switch operable to couple the gate of the sixth PMOS transistor to the drain of the third PMOS transistor when the band-gap reference circuit is in the first state.

10. The band-gap reference circuit of claim 9, further comprising:

a third resistor coupled to the drain of the fifth PMOS transistor;

a fourth resistor;

a fifth second-state switch operable to couple the fourth resistor to the third resistor when the band-gap reference circuit is in the second state;

a fifth resistor coupled to the drain of the sixth PMOS transistor;

a sixth resistor;

a fifth first-state switch operable to couple the sixth resistor to the fifth resistor when the band-gap reference circuit is in the first state; and a capacitor coupled to the fourth resistor and the sixth resistor and to ground.

11. The band-gap reference circuit of claim 10, further comprising:

a seventh PMOS transistor having a source coupled to the power supply and a gate coupled to the gate of the fifth PMOS transistor and the gate of the sixth PMOS transistor;

a sixth first-state switch operable to couple a drain of the seventh PMOS transistor to the third resistor when the band-gap reference circuit is in the first state; and a sixth second-state switch operable to couple the drain of the seventh PMOS transistor to the fifth resistor when the band-gap reference circuit is in the second state.

12. The band-gap reference circuit of claim 11, the first resistor, the second resistor, the third resistor and the fifth resistor comprising about 10 kΩ of resistance, the fourth resistor and the sixth resistor comprising about 40 kΩ of resistance, and the capacitor comprising about 40 pF of capacitance.

13. The band-gap reference circuit of claim 11, the specified duty cycle comprising about 50%.

14. A transceiver, comprising:

a digital-to-analog converter operable to receive a digital output signal and to generate an analog output signal based on the digital output signal;

a voltage-to-current converter coupled to the digital-to-analog converter, the voltage-to-current converter operable to receive a reference voltage, to generate a specified current based on the reference voltage, and to provide the specified current to the digital-to-analog converter;

a band-gap reference circuit coupled to the voltage-to-current converter, the band-gap reference circuit operable to generate the reference voltage and to provide the reference voltage to the voltage-to-current converter;

an analog-to-digital converter coupled to the band-gap reference circuit, the analog-to-digital converter operable to receive an analog input signal and the reference voltage and to generate a digital input signal based on the analog input signal and the reference voltage; and the band-gap reference circuit comprising a differential amplifier circuit comprising a first input node operable to receive a first input signal and a second input node operable to receive a second input signal, the band-gap reference circuit operable to alternate between a first state and a second state based on a specified duty cycle, the first input node comprising an inverting node and the second input node comprising a non-inverting node in the first state, and the first input node comprising a non-inverting node and the second input node comprising an inverting node in the second state, and the differential amplifier circuit operable to generate an output signal based on a difference between the first and second input signals.

15. The transceiver of claim 14, the specified duty cycle comprising about 50%.

16. The transceiver of claim 15, the band-gap reference circuit further comprising:

a first low current circuit coupled to the differential amplifier circuit, the first low current circuit operable to receive the output signal and to generate the first input signal based on the output signal; and a second low current circuit coupled to the differential amplifier circuit, the second low current circuit operable to receive the output signal and to generate the second input signal based on the output signal.

17. The transceiver of claim 16, the band-gap reference circuit further comprising a filter coupled to the first and second low current circuits, the filter comprising a reference voltage node operable to provide a reference voltage.

18. The transceiver of claim 17, the filter operable to filter out switching spikes at the reference voltage node.

19. The transceiver of claim 18, the band-gap reference circuit further comprising a high current circuit coupled to the first and second low current circuits and to the filter, the high current circuit operable to provide a bias voltage for the first and second low current circuits.

20. The transceiver of claim 19, the high current circuit further operable to provide a filter current to the filter.

* * * * *